US006230381B1

(12) United States Patent
Newton

(10) Patent No.: US 6,230,381 B1
(45) Date of Patent: May 15, 2001

(54) PIPE FITTER'S HELPER

(76) Inventor: Woodie C. Newton, 3704 Noble Dr., Snyder, TX (US) 79549

( * ) Notice: Subject to any disclaimer, the term of this patent is extended or adjusted under 35 U.S.C. 154(b) by 0 days.

(21) Appl. No.: 09/500,584

(22) Filed: Feb. 10, 2000

(51) Int. Cl.[7] ..... B25B 27/14
(52) U.S. Cl. ..... 29/272; 269/43
(58) Field of Search ..... 269/4.3, 48.1; 29/271, 272; 228/49.3, 49.1

(56) References Cited

U.S. PATENT DOCUMENTS 3,619,891 * 11/1971 Harrison ..... 269/43
3,735,472 5/1973 Silverman .
4,143,450 3/1979 Selden et al. .

FOREIGN PATENT DOCUMENTS 492297 2/1930 (DE) .
18341 of 1910 (GB) .

* cited by examiner

*Primary Examiner*—Robert C. Watson
(74) *Attorney, Agent, or Firm*—Stephen R. Greiner

(57) ABSTRACT

A tool for supporting a fitting adjacent the end of a pipe during welding. The tool includes a Y-shaped body having an upright with a threaded, interior passageway from which a screw downwardly extends. A pair of opposed arms project from the upright. A pair of plates extends forwardly from the distal ends of the opposed arms. Each of the plates has a threaded bore within which is threadably secured a thumb-screw. By rotating the screw to extend such from body, the tool can be selectively clamped with the end of a piece of pipe during use.

3 Claims, 1 Drawing Sheet

PIPE FITTER'S HELPER

FIELD OF THE INVENTION

The present invention relates generally to metal working tools and, in particular, to a device for aligning one tube with another.

BACKGROUND OF THE INVENTION

Joining elbows, tees, flanges and other fittings to the ends of pipes by welding has never been an easy task. Today, the process requires the use of cumbersome lifting and clamping devices for holding the fitting in place during welding. Often, manipulating such devices to place a fitting requires more time than is required to perform the actual welding—a significant problem if many fittings are being welded as can occur during a refinery or pipeline overhaul. A need, therefore, exists for a tool that can be used to rapidly and accurately position a fitting at the end of a pipe for welding.

SUMMARY OF THE INVENTION

In light of the problems associated with the known devices and methods employed to weld a fitting onto a pipe, it is a principal object of the invention to provide a pipe fitter's helper, i.e., a tool that can be used to quickly, easily and safely position pipefittings at pipe ends for welding. The saving of time can, with large welding projects, significantly reduce manpower needs and the cost of the project.

It is another object of the invention to provide a pipe fitter's helper of the type described which can be used with minimal training and without the need of any additional tools to set it in place or remove it from a pipe after use.

It is an object of the invention to provide improved elements and arrangements thereof in a pipe fitter's helper for the purposes described which is lightweight in construction, inexpensive to manufacture, and dependable in use.

Briefly, the pipe fitter's helper in accordance with this invention achieves the intended objects by featuring a Y-shaped body having an upright with a threaded, interior passageway from which a screw extends. A pair of opposed arms project upwardly and laterally from the upright. A pair of plates extends forwardly from the distal ends of the opposed arms. Each of the plates has a threaded bore within which is threadably secured a thumbscrew.

The foregoing and other objects, features and advantages of the present invention will become readily apparent upon further review of the following detailed description of the preferred embodiment as illustrated in the accompanying drawings.

BRIEF DESCRIPTION OF THE DRAWINGS

The present invention may be more readily described with reference to the accompanying drawings, in which.

Similar reference characters denote corresponding features consistently throughout the accompanying drawings.

DETAILED DESCRIPTION OF THE PREFERRED EMBODIMENT

Figure 1:
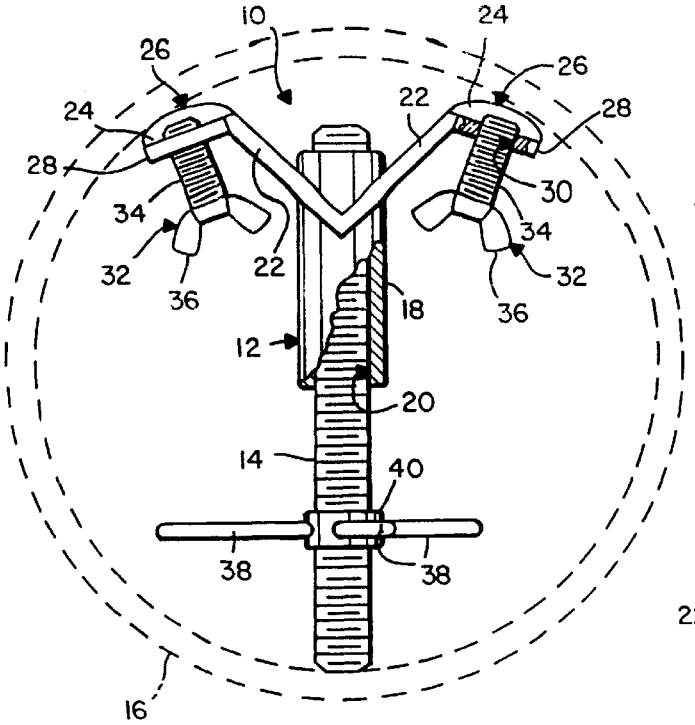
FIG. 1 is a front view of a pipe fitter's helper in accordance with the present invention shown clamped within a pipe.
Figure 2:
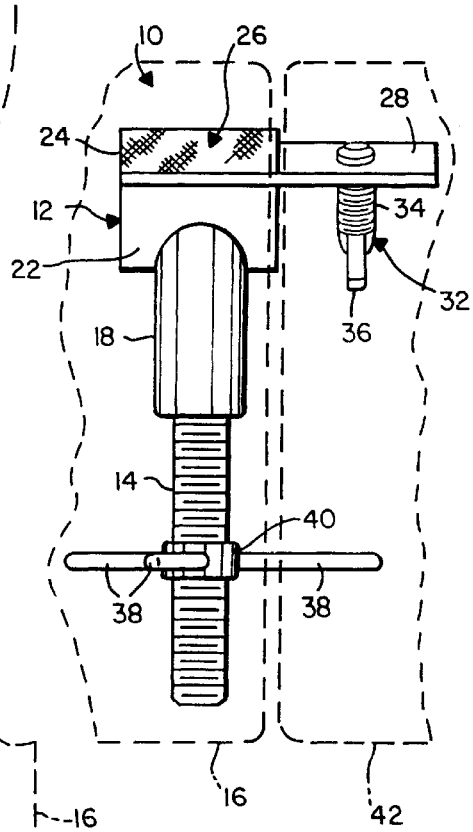
FIG. 2 is a side view of the pipe fitter's helper of FIG. 1.
Figure 3:
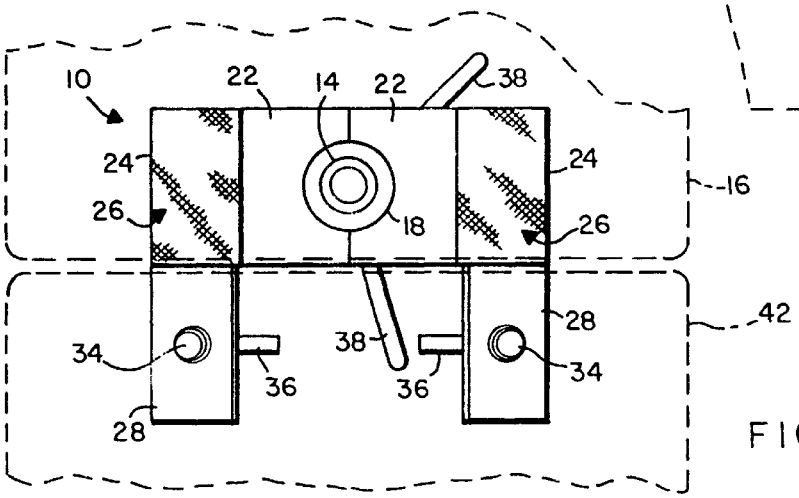
FIG. 3 is a top view of the pipe fitters helper.

Referring now to the FIGS., a pipe fitter's helper in accordance with the present invention is shown at 10. Pipe fitter's helper 10 includes a generally Y-shaped body 12 from which a screw 14 extends downwardly. By rotating screw 14 to extend such from body 12, pipe fitter's helper 10 can be selectively clamped with a pipe 16 during use.

Body 12 includes an upright 18 having an interior passageway 20 that is threaded along its length and terminates at openings in the top and bottom of upright 18. Extending upwardly and laterally from the top of upright 18 is a pair of opposed arms 22. Arms 22 are joined at their inner/lower ends to transfer loads to one another and to upright 18. At the distal/upper end of each of the arms 22 is affixed a pad 24 with a rough, ridged top surface 26 for gripping the interior of pipe 16. It is of note that top surface 26 is also curved to snugly engage pipes of different diameters.

A plate 28 extends forwardly from the outer/upper end of each of the arms 22. Each plate 28 is provided with a threaded bore 30 within which is fitted a thumbscrew 32. The threaded shaft 34 of each thumbscrew 32 is adapted to pass through a bore 30 and extend upwardly from a plate 28. The broad, flat head 36 of each thumbscrew 32 is positioned beneath the plate 28 to which it is threadably fastened and may be turned by the thumb and fingers of a user.

Screw 14 is threadably fastened within passageway 20 of upright 12. As shown, screw 14 is about twice the length of passageway 20 making it possible, by turning screw 14, to adjust the height of pipe fitter's helper 10 to about 1.5 times that of screw 14. The turning of screw 14 is facilitated by a plurality of handles 38 which extend radially outwardly therefrom at a set height between the upper and lower end of the screw 14. Handles 14 are reinforced in their attachment to screw 14 by a mounting collar 40 that is permanently affixed to screw 14.

Use of pipe fitter's helper 10 is straightforward. First, helper 10 is positioned in the end of a pipe 16 with plates 28 projecting outwardly therefrom. Next, by grasping handles 38, screw 14 rotatably extended from upright 18 so that the bottom of screw 14 and top surface 26 of pads 24 snugly grip the bottom and top of pipe 16. Pipe fitting 42 is, then, suspended from plates 28. By rotating thumbscrews 32, fitting 42 may be raised or lowered to bring it into perfect alignment with pipe 16. Welding may now proceed in a conventional manner.

After fitting 42 has been tacked in place or fully welded to pipe 16, pipe fitter's helper 10 is withdrawn through fitting 42 by reversing the steps outlined above and reused. The entire process of installing, using and removing helper 10 requires only a few minutes under most circumstances. Thus, use of helper 10 is fast, simple and safe.

While the invention has been described with a high degree of particularity, it will be appreciated by those skilled in the art that modifications may be made thereto. For example, a cross piece (not shown) can be employed to connect plates 28 together and reinforce such. Therefore, it is to be understood that the present invention is not limited to the sole embodiment described above, but encompasses any and all embodiments within the scope of the following claims.

I claim:

1. A pipe fitter's helper, comprising:

a Y-shaped body including:

an upright having an interior passageway that is threaded and that terminates at openings in the top and bottom of said upright;

a pair of opposed arms projecting upwardly from the top of said upright, said opposed arms terminating at distal ends; and, a pair of plates each extending forwardly from said distal end of one of said opposed arms, each of said plates having a threaded bore therein;

a pair of thumbscrews, each being respectively threadably secured within one of said threaded bores;

a screw extending downwardly from said passageway and being threadably engaged with said upright; and, a handle extending from said screw for rotating said screw.

2. A pipe fitter's helper, comprising:

a body including:

an upright having a threaded, interior passageway;

a pair of opposed arms projecting upwardly from said upright, said opposed arms terminating at distal ends; and, a pair of plates each extending respectively forwardly from said distal end of one of said opposed arms, each of said plates having a threaded bore therein;

a pair of pads, each being respectively secured to said distal end of one of said opposed arms, each of said pads having a curved, top surface for engaging the interior of a pipe;

a pair of thumbscrews, each being respectively threadably secured within one of said threaded bores;

a screw extending downwardly from said passageway and being threadably engaged with said upright; and, a handle extending from said screw for rotating said screw.

3. A pipe fitter's helper, comprising:

a Y-shaped body including:

an upright having an interior passageway that is threaded and that terminates at openings in the top and bottom of said upright;

a pair of opposed arms projecting upwardly from the top of said upright, said opposed arms terminating at distal ends; and, a pair of plates each extending respectively forwardly from said distal end of one of said opposed arms, each of said plates having a threaded bore therein;

a pair of pads, each being respectively secured to said distal end of one of said opposed arms, each of said pads having a curved, top surface that is rough and ridged for gripping the interior of a pipe;

a pair of thumbscrews, each being respectively threadably secured within one of said threaded bores;

a screw extending downwardly from said passageway and being threadably engaged with said upright; and, a handle extending from said screw for rotating said screw.

* * * * *